US012594480B2

(12) United States Patent
Beom et al.

(10) Patent No.: US 12,594,480 B2
(45) Date of Patent: Apr. 7, 2026

(54) EXERCISE SUPPORT DEVICE OPERATING WITH WEIGHT TRAINING EQUIPMENT

(71) Applicant: LG ELECTRONICS INC., Seoul (KR)

(72) Inventors: Sungwon Beom, Seoul (KR); Junyoung Huh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 172 days.

(21) Appl. No.: 18/206,799

(22) Filed: Jun. 7, 2023

(65) Prior Publication Data

US 2024/0058684 A1 Feb. 22, 2024

(30) Foreign Application Priority Data

Aug. 22, 2022 (KR) ..... 10-2022-0104886
Dec. 28, 2022 (KR) ..... 10-2022-0187254

(51) Int. Cl.
*A63B 21/00* (2006.01)
*A63B 21/005* (2006.01)
(Continued)

(52) U.S. Cl.
CPC ..... *A63B 71/0622* (2013.01); *A63B 21/0058* (2013.01); *A63B 21/153* (2013.01); *A63B 24/0062* (2013.01); *A63B 2024/0065* (2013.01); *A63B 2024/0068* (2013.01); *A63B 2071/065* (2013.01); *A63B 2220/05* (2013.01); *A63B 2220/30* (2013.01); *A63B 2220/807* (2013.01);
(Continued)

(58) Field of Classification Search
None
See application file for complete search history.

(56) References Cited

U.S. PATENT DOCUMENTS 9,757,605 B2 9/2017 Olson et al.
2005/0075213 A1 4/2005 Arick
(Continued)

FOREIGN PATENT DOCUMENTS

CA 2551734 4/2014
CN 110298221 * 10/2019
(Continued)

OTHER PUBLICATIONS

International Search Report and Written Opinion dated Oct. 17, 2023 issued in Application No. PCT/KR2023/009020.
(Continued)

*Primary Examiner* — Beniyam Menberu
(74) *Attorney, Agent, or Firm* — KED & ASSOCIATES, LLP

(57) ABSTRACT

Proposed is an exercise support device operating with a weight training equipment. The exercise support device can extract an exercise object exercising on the weight training equipment connected presently to the exercise support device from a video captured by a camera module by analyzing the skeleton data of candidate objects. Through this, when the multiple candidate objects are detected in an exercise video, a user exercising on the weight training equipment which presently operates with the exercise support device can be accurately specified by using an exercise type and the skeleton data of the candidate objects.

15 Claims, 10 Drawing Sheets

(51) Int. Cl.
*A63B 24/00* (2006.01)
*A63B 71/06* (2006.01)

(52) U.S. Cl.
CPC ..... *A63B 2225/20* (2013.01); *A63B 2230/62* (2013.01)

(56) References Cited

U.S. PATENT DOCUMENTS

| | | | | |
|---|---|---|---|---|
| 2010/0179028 | A1 | 7/2010 | Watterson et al. | |
| 2010/0267521 | A1 | 10/2010 | Matsunaga | |
| 2012/0237911 | A1 | 9/2012 | Watterson | |
| 2015/0080183 | A1 | 3/2015 | Alessandri et al. | |
| 2016/0250514 | A1 | 9/2016 | Gvoich | |
| 2019/0208114 | A1* | 7/2019 | Ginat | G06V 20/56 |
| 2020/0289891 | A1* | 9/2020 | Owusu | A63B 21/072 |
| 2020/0302617 | A1* | 9/2020 | Yabuki | G06T 7/11 |
| 2022/0008775 | A1 | 1/2022 | Rubin et al. | |
| 2022/0028518 | A1 | 1/2022 | Foley et al. | |
| 2022/0062738 | A1 | 3/2022 | Neuhaus et al. | |
| 2022/0072381 | A1 | 3/2022 | Trehan | |
| 2022/0111245 | A1 | 4/2022 | Gregory | |
| 2022/0128373 | A1 | 4/2022 | Lee | |
| 2022/0314071 | A1* | 10/2022 | Sauter | A63B 21/00 |
| 2024/0149115 | A1* | 5/2024 | Yoon | A63B 71/0622 |

FOREIGN PATENT DOCUMENTS

| | | | | |
|---|---|---|---|---|
| CN | 110298309 | * | 10/2019 | G06V 20/46 |
| CN | 112512644 | | 3/2021 | |
| CN | 113762133 | * | 12/2021 | A63B 71/06 |
| EP | 3108469 | | 12/2019 | |
| JP | 2007-226388 | | 9/2007 | |
| KR | 20-0326767 | | 9/2003 | |
| KR | 20150075988 | * | 7/2015 | G06Q 10/109 |
| KR | 10-2019724 | | 9/2019 | |
| KR | 10-2021-0028154 | | 3/2021 | |
| KR | 20220061511 | * | 5/2022 | A63B 24/0006 |
| KR | 102429323 | * | 8/2022 | A63B 71/06 |
| KR | 102438488 | * | 9/2022 | G06T 13/40 |
| WO | WO 2015/137566 | | 9/2015 | |
| WO | WO 2020/033508 | | 2/2020 | |
| WO | WO 2021-141186 | | 7/2021 | |
| WO | WO 2021/151127 | | 8/2021 | |
| WO | WO 2022/103278 | | 5/2022 | |
| WO | WO 2022/165551 | | 8/2022 | |
| WO | WO 2022161037 | * | 8/2022 | A63F 13/213 |

OTHER PUBLICATIONS

International Search Report dated Aug. 3, 2023 issued in Application No. PCT/KR2023/005865.
International Search Report dated Aug. 21, 2023 issued in Application No. PCT/KR2023/005850.
International Search Report dated Jul. 28, 2023 issued in Application No. PCT/KR2023/005852.
Extended European Search Report dated Oct. 7, 2025 issued in Application No. 23857471.9.
Extended European Search Report dated Oct. 7, 2025 issued in Application No. 23857473.5.
Vitruvian Trainer+ First Look & Demo, Author: Fitness Equipment Café Tv, dated Nov. 22, 2021, XP093315196, Retrieved from the Internet: URL: https://www.youtube.com/watch?v=EU956QFQpuo, retrieved on Sep. 15, 2025.

* cited by examiner

EXERCISE SUPPORT DEVICE OPERATING WITH WEIGHT TRAINING EQUIPMENT

CROSS-REFERENCE TO RELATED APPLICATION(S)

The present application claims priority to Korean Patent Applications No. 10-2022-0104886, filed in Korea on Aug. 22, 2022 and No. 10-2022-0187254, filed in Korea on Dec. 28, 2022, the entire contents of which are incorporated herein for all purposes by this reference.

BACKGROUND

1. Field

The present disclosure relates generally to an exercise support device operating with a weight training equipment. More particularly, the present disclosure relates to an exercise support device which displays a user's exercise video by operating in cooperation with a weight training equipment.

2. Background

In general, a weight training equipment used for increasing muscular strength is designed to repeat muscle relaxation and contraction while a lever connected to a weight of a predetermined unit of weight is pushed or pulled. Such an exercise device includes various types of exercise devices, such as an arm curl machine for biceps exercises, a chest press or butterfly machine for exercises for chest, such as pectoralis major, and a pull-up device for a muscle exercise.

Recently, as part of self-management, a home workout, which is exercise for health management at home which is a user's own resting place without jogging or visiting a fitness center has become an issue. In response to this issue, various types of exercise devices for a home workout have been proposed, and a new phrase called a home workout group has been created. As one example of a weight training equipment for a home workout, a weight training equipment using a cable is being used. A drive motor is installed inside the weight training equipment, and an exercise load supplied from the drive motor is transmitted to a user through the cable so that the user performs a muscle exercise by pulling or releasing the cable.

Meanwhile, in muscle exercise, exercise efficiency can be increased only when the muscle exercise is performed in a correct posture, and continuous exercise in a wrong posture may adversely affect the body. Accordingly, a method of capturing a user exercising through a weight training equipment with a camera module and displaying a captured video on a screen has been proposed. For example, a user's exercise video is displayed on the screen of a mobile device, such as a tablet, or of a TV.

However, when a user wants to see only his or her exercise video on a screen while a number of users are exercising in the case of a fitness center, it is difficult to specify the user. For example, when a camera module is placed so that only a user is displayed on a screen, only the user's exercise video can be seen, but when the installation position of the camera module is limited in a fitness center, multiple other users including the user are displayed on the screen, it is impossible to see only the user's exercise video.

In addition, when multiple users are displayed on the screen, a user's exercise video is relatively small, and thus it is difficult to accurately determine his or her exercise posture. Even in a home workout, even if other people at home, such as children, copy an exerciser's exercise or do other actions next to a weight training equipment, the exerciser may want only his or her exercise video to be displayed on a screen.

BRIEF DESCRIPTION OF THE DRAWINGS

Embodiments will be described in detail with reference to the following drawings in which like reference numerals refer to like elements, and wherein.

DETAILED DESCRIPTION

Advantages and characteristics of the present disclosure, and methods for achieving them will become clear with reference to embodiments described later in detail in conjunction with the accompanying drawings. However, the present disclosure is not limited to the embodiments disclosed below and may be implemented in a variety of different forms. However, these embodiments are provided to make the disclosure of the present disclosure complete and to completely inform those skilled in the art of the scope of the invention to which the present disclosure belongs, and the present disclosure is only defined by the scope of the claims. The same reference numbers designate the same elements throughout the specification.

Figure 1:
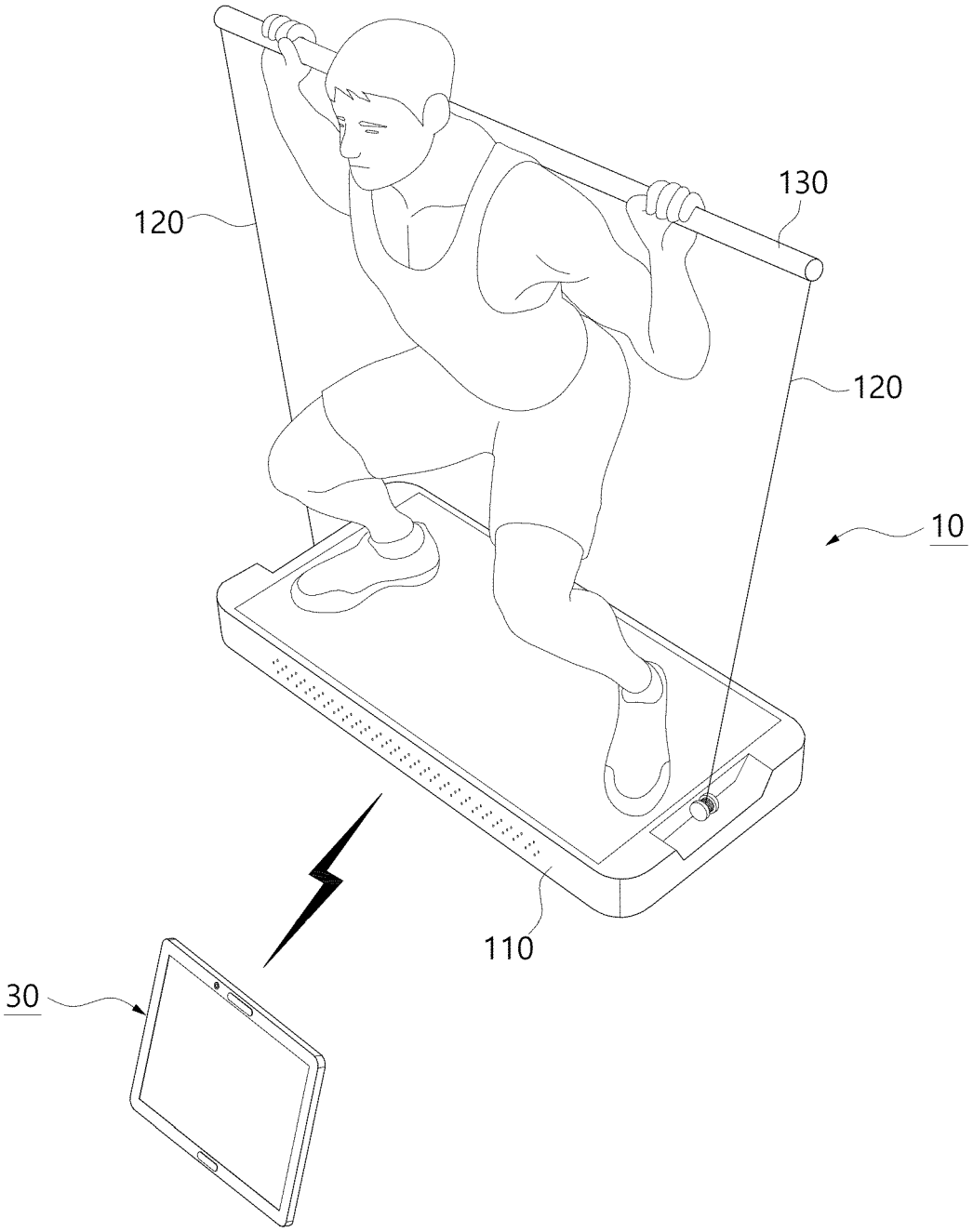
FIG. 1 is a view illustrating an example of operation of an exercise support device and a weight training equipment according to the embodiment of the present disclosure.

FIG. 1 is a view illustrating an example of operation of an exercise support device (also referred to as a user device or terminal) 30 and a weight training equipment 10 according to the embodiment of the present disclosure. The weight training equipment 10 according to the embodiment of the present disclosure may have a structure in which a user performs muscle exercise by pulling or releasing a pair of cables 120.

Referring to FIG. 1, the weight training equipment 10 may include a device body 110. In the embodiment of the present disclosure, the device body 110 may have the shape of a mat. While the device body 110 is seated on an indoor or outdoor floor, a user steps on the device body 110 and performs muscle exercise by using the pair of cables 120 extending to the outside from the device body 110.

Here, a gripping instrument for a user to grip and exercise may be connected to the pair of cables 120. In FIG. 1, the cables 120 are respectively connected to the opposite ends of a handle bar 130. In addition, a grip such as a D-type grip may be connected to each of the cables 120 at opposite sides, and various types of gripping instruments for exercise may be connected thereto.

Figure 2:
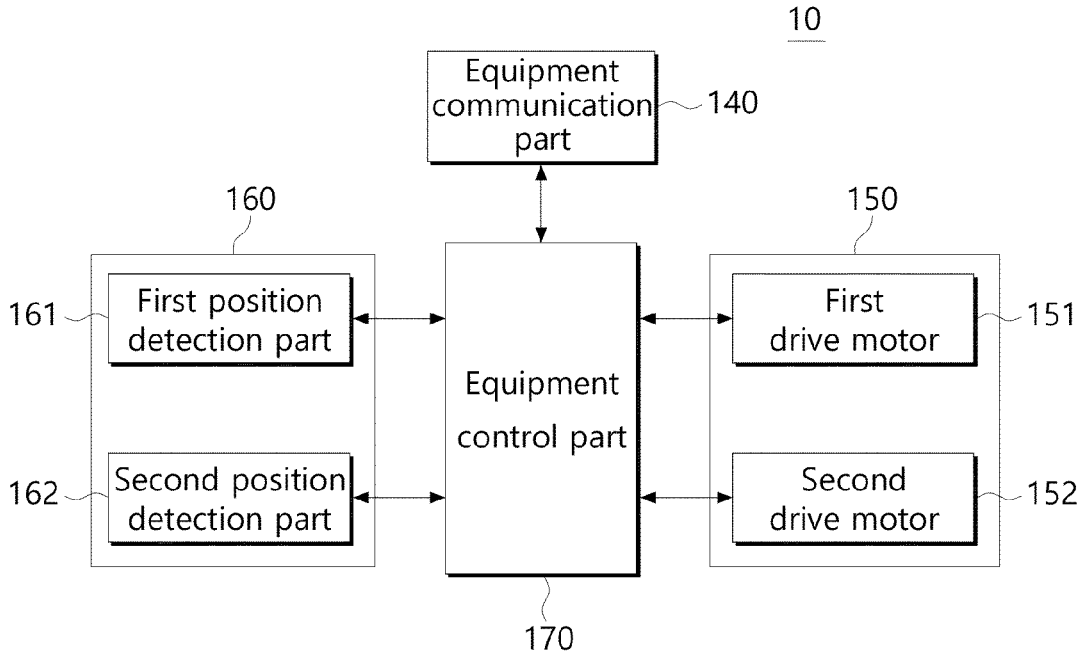
FIG. 2 is a control block diagram of the weight training equipment according to the embodiment of the present disclosure.

FIG. 2 is a control block diagram of the weight training equipment 10 according to the embodiment of the present disclosure. Referring to FIG. 2, the weight training equipment 10 according to the embodiment of the present disclosure may include a load supply module 150. The load supply module 150 according to the embodiment of the present disclosure may generate an exercise load and provide the generated exercise load to a user through the pair of cables 120.

In the embodiment of the present disclosure, the load supply module 150 may include a first drive motor 151 and a second drive motor 152. Each of the first drive motor 151 and the second drive motor 152 may independently generate an exercise load, and may provide the generated exercise load through each cable 120.

Through this, in a state in which the first drive motor 151 and the second drive motor 152 output exercise loads corresponding to each other, as a squat exercise illustrated in FIG. 1, the pair of cables 120 may be pulled and released in the same directions so that the exercise can be performed. In addition, with a D-type grip connected to each of the cables 120, the pair of cables 120 may be pulled and released in directions different from each other. Furthermore, a one-handed exercise may be performed by using only one cable 120.

In the embodiment illustrated in FIG. 2, the first drive motor 151 and the second drive motor 152 independently generate exercise loads, but one drive motor and a differential mechanism may be used so that the same exercise loads can be provided to the pair of cables 120.

Meanwhile, the weight training equipment 10 according to the embodiment of the present disclosure may include a position detection part 1 (or position sensor) 60. In the embodiment, the position detection part 160 may detect the moving-out positions of the cables 120. As described above, the first drive motor 151 and the second drive motor 152 may be independently connected respectively to the cables 120, and the position detection part 160 may include a first position detection part 161 and a second position detection part 162. Here, the first position detection part 161 may detect the moving-out position of a first side cable 120 of the pair of cables 120, and the second position detection part 162 may detect the moving-out position of a second side cable 120 of the pair of cables 120.

In the embodiment, the first position detection part 161 and the second position detection part 162 may directly or indirectly detect the amount of the rotation of the first drive motor 151 and the second drive motor 152, respectively to detect the moving-out positions of the cables 120, respectively. For example, the first position detection part 161 and the second position detection part 162 may respectively detect the rotations of the first drive motor 151 and the second drive motor 152.

Figure 3:
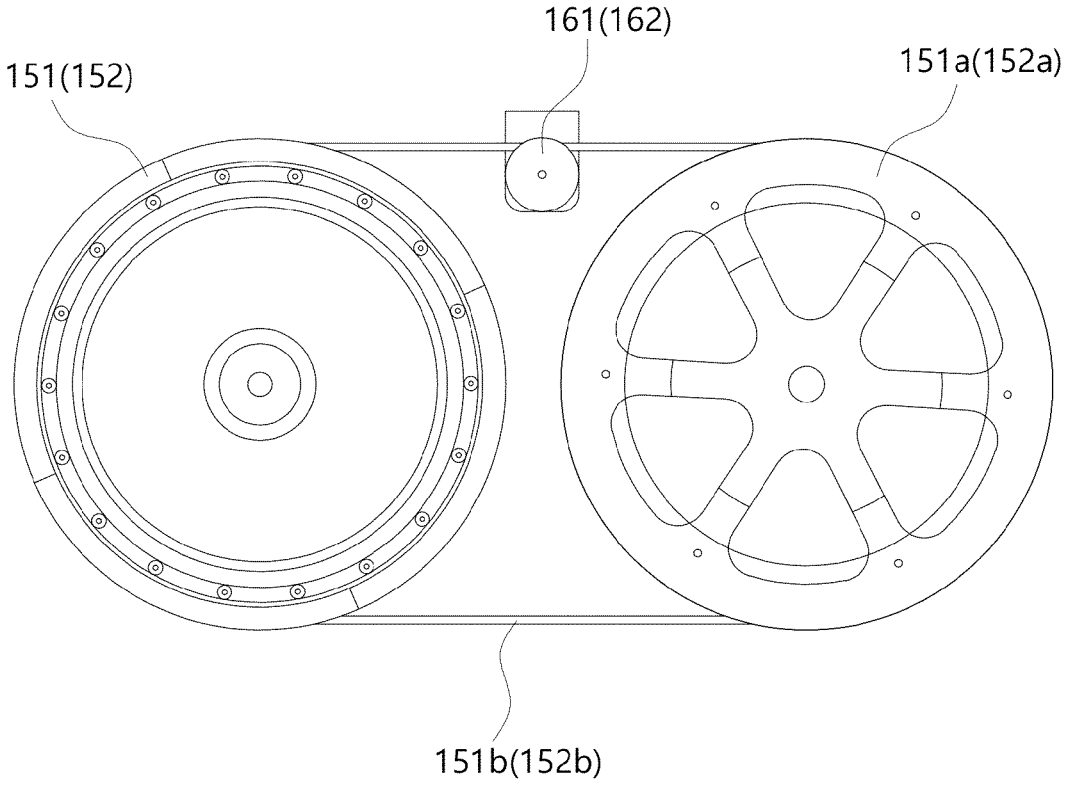
FIG. 3 is a view illustrating an example of a first drive system and a second drive system of the weight training equipment according to the embodiment of the present disclosure.

For another example, the load supply module 150 according to the embodiment of the present disclosure may include a first drive system and a second drive system for transmitting the rotational forces of the first drive motor 151 and the second drive motor 152 to the cables 120, respectively. For example, as illustrated in FIG. 3, the first drive system and the second drive system may each include a bobbin, a timing belt 151*b* or 152*b*, and a transmission pulley 151*a* or 152*a*.

The transmission pulley 151*a* or 152*a* may be connected to the first drive motor 151 or the second drive motor 152 through the timing belt 151*b* or 152*b* and may rotate in synchronization with the rotation of the first drive motor 151 or the second drive motor 152. In addition, with the cable 120 wound on the bobbin, the bobbin may be coaxially coupled to the transmission pulley 151*a* or 152*a* to rotate in synchronization with the rotation of the transmission pulley 151*a* or 152*a*, and thus the exercise load of the first drive motor 151 or the second drive motor 152 transmitted through the timing belt 151*b* or 152*b* and the transmission pulley 151*a* or 152*a* may be transmitted to each of the cables 120.

Here, the first position detection part 161 and the second position detection part 162 may detect the forward and reverse directional movements of the timing belt 151*b* or 152*b* according to the rotation of each of the first drive motor 151 and the second drive motor 152 so that the moving-out position of each cable 120 can be detected. The configuration of the first position detection part 161 and the second position detection part 162 according to the embodiment of the present disclosure is not limited to the above-described embodiment, and the first position detection part 161 and the second position detection part 162 may be configured in various forms to detect the positions of the cables 120 moving according to a user's exercise.

Referring back to FIG. 2, the weight training equipment 10 according to the embodiment of the present disclosure may include an equipment communication part (or equipment communication interface) 140. For example, the equipment communication part 140 may be connected to the exercise support device 30 through a communication network such as Bluetooth® or Wi-Fi.

The weight training equipment 10 according to the embodiment of the present disclosure may include a device control part (or equipment controller) 170. The equipment control part 170 may control the entire function of the weight training equipment 10 according to the embodiment of the present disclosure. For example, the equipment control part 170 may control the first drive motor 151 and the second drive motor 152 so that an exercise load is increased to a target load preset by a user to be output.

In the embodiment of the present disclosure, the equipment control part 170 may transmit device exercise information based on the moving-out positions of the cables 120 detected respectively by the first position detection part 161 and the second position detection part 162 to the exercise support device 30 through the equipment communication part 140, and description thereof will be described later. Meanwhile, the exercise support device 30 according to the embodiment of the present disclosure may be connected to the weight training equipment 10 through the communication network to operate in cooperation with the weight training equipment 10.

In the embodiment illustrated in FIG. 1, the exercise support device 30 is provided in the form of a tablet. In addition, the exercise support device 30 may be provided in various forms such as a mobile device such as a smartphone, a laptop computer, a desktop computer, and a TV.

Figure 4:
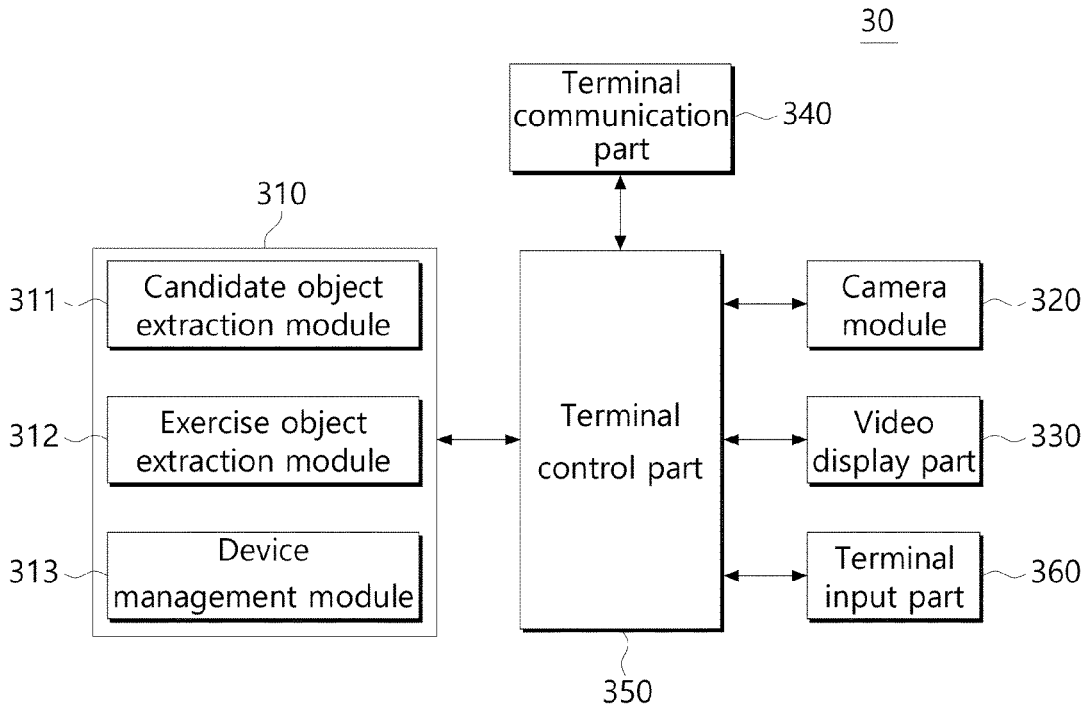
FIG. 4 is a control block diagram of the exercise support device according to the embodiment of the present disclosure.

FIG. 4 is a control block diagram of the exercise support device 30 according to the embodiment of the present disclosure. Referring to FIG. 4, the exercise support device 30 according to the embodiment of the present disclosure may include a terminal communication part (or terminal communication interface) 340. In the embodiment, the terminal communication part 340 may be connected to the equipment communication part 140 of the weight training equipment 10 through a communication network such as Bluetooth® and Wi-Fi. In addition, the terminal communication part 340 may receive the device exercise information from the weight training equipment 10.

The exercise support device 30 according to the embodiment of the present disclosure may include a camera module (or camera) 320. In the embodiment, the camera module 320 may be disposed to be directed toward the weight training equipment 10 and may capture a user exercising on the weight training equipment 10.

In the embodiment of the present disclosure, the camera module 320 may include a CMOS image sensor and, for an example, may be installed on the front surface of the exercise support device 30 to capture a user's exercise video. For another example, a separate camera module 320 for capturing a video may be connected to the exercise support device 30, and the exercise support device 30 may receive a video captured by the associated camera module 320 through wired or wireless communication.

The exercise support device 30 according to the embodiment of the present disclosure may include a video display part (or display) 330. For example, when the exercise support device 30 according to the embodiment of the present disclosure is provided in the form of a tablet or in the form of a mobile device such as a smart phone, the video display part 330 may be formed on a front surface of the exercise support device 30. For another example, when the exercise support device 30 according to the embodiment of the present disclosure is a laptop or desktop computer, the video display part 330 may be provided in the form of a monitor, and when the exercise support device 30 is a TV, the screen of TV may be the video display part 330. Here, the video display part 330 may be provided as a liquid crystal display (LCD) panel, a light emitting diode (LED) panel, or an organic light emitting diode (an OLED panel, etc., and a graphic user interface provided by a device management module 313 to be described later may be displayed on the screen of the video display part.

The exercise support device 30 according to the embodiment of the present disclosure may include a candidate object extraction module 311. Here, the candidate object extraction module 311 may extract the skeleton data of a plurality of candidate objects in a video captured by the camera module 320. In the embodiment, the candidate object extraction module 311 may determine a moving target in a captured video and extract the associated target as a candidate object. In addition, the candidate object extraction module 311 may extract a plurality of preset key points of the candidate object as the skeleton data.

Figure 5:
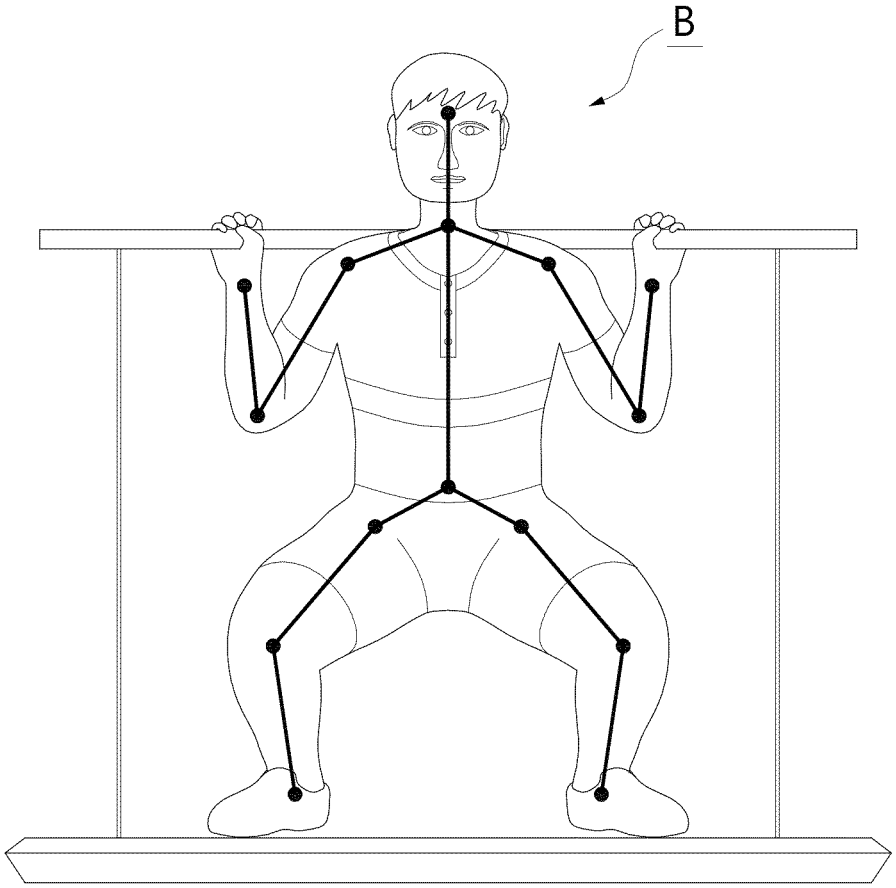
FIGS. 5 and 6 are views illustrating examples of skeleton data extraction of a candidate object extraction module of the exercise support device according to the embodiment of the present disclosure.
Figure 6:
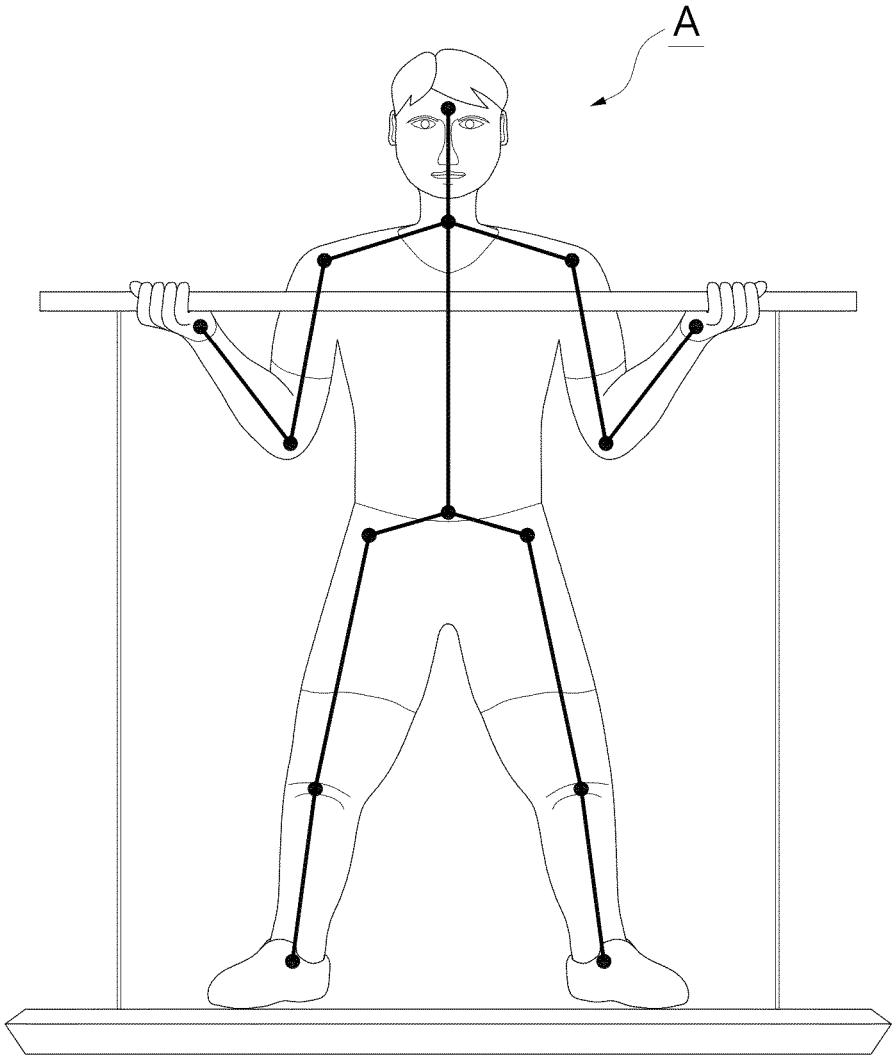

FIG. 5 is a view illustrating an example in which the candidate object extraction module 311 according to the embodiment of the present disclosure extracts the skeleton data of a user doing a squat exercise, and FIG. 6 is a view illustrating an example in which the candidate object extraction module 311 according to the embodiment of the present disclosure extracts the skeleton data of a user doing a cable arm curl exercise.

As illustrated in FIGS. 5 and 6, the positions of the head, neck, hip, and multiple joints of a person who is a candidate object may be extracted as skeleton data. In the embodiment, locations of the plurality of multiple joints may include both shoulders, both elbows, both hands or wrists, both hips, both knees, and both ankles. In the embodiment, the candidate object extraction module 311 may extract the skeleton data of the candidate object by using an algorithm such as OpenVINO Library.

The exercise support device 30 according to the embodiment of the present disclosure may include an exercise object extraction module 312. The exercise object extraction module 312 may analyze the skeleton data of each of the candidate objects, and may extract a candidate object of the candidate objects, as a main exercise object, exercising on the weight training equipment 10 connected to the exercise support device through the terminal communication part 340. In the embodiment, the exercise object extraction module 312 may extract one corresponding to an exercise type performed by the weight training equipment 10 connected through the terminal communication part 340 as a main exercise object.

As illustrated in FIGS. 5 and 6, the skeleton data extracted by the candidate object extraction module 311 may have a different aspect according to an exercise type that a user is performing on the weight training equipment 10. Accordingly, the exercise object extraction module 312 may analyze the skeleton data of the candidate object, and may extract a candidate object, as a main exercise object, having the skeleton data of the exercise type performed on the weight training equipment 10 connected presently through the terminal communication part 340.

In the embodiment of the present disclosure, the exercise object extraction module 312 may include an artificial intelligence-based artificial intelligence model. For example, the artificial intelligence model may be generated based on a deep learning-based algorithm such as a convolution neural network (CNN), a k-nearest neighborhood (KNN), or a deep neural network (DNN).

In the artificial intelligence model, a plurality of skeleton data for learning which is each labeled with exercise types may be used as learning data, and the exercise types may be used as output data to be learned and generated. Accordingly, when the skeleton data of each candidate object is input, the artificial intelligence model may determine the exercise type of the candidate object through an inference process.

In the embodiment, for one exercise type, a set of multiple skeleton data may be applied as skeleton data for learning. For example, a set of time series of skeleton data for one exercise cycle may be learned as the skeleton data for learning. In addition, the artificial intelligence model may receive skeleton data of each candidate object in a time-sequential manner from the candidate object extraction module 311, and may infer the exercise type of the associated candidate object.

Figure 7:
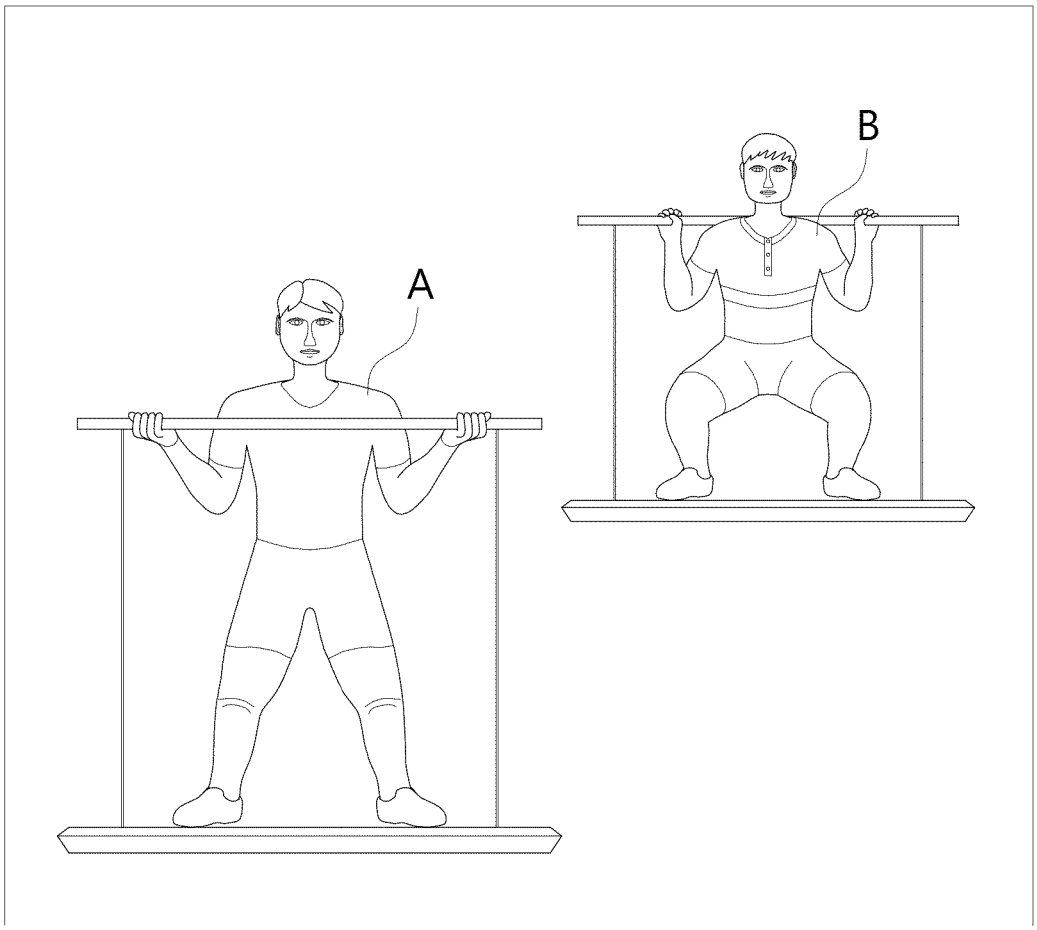
FIG. 7 is a view illustrating an example of the situation of exercise using the weight training equipment according to the embodiment of the present disclosure.

FIG. 7 is a view illustrating an example of the situation of exercise using the weight training equipment 10 according to the embodiment of the present disclosure, and illustrates a situation in which two candidate objects are extracted from a video captured by the camera module 320. In FIG. 7, a candidate object A is performing a cable arm curl exercise, and a candidate object B is performing a squat exercise. Here, as illustrated in FIGS. 5 and 6, the skeleton data of each candidate object may be extracted by the candidate object extraction module 311.

As described above, the artificial intelligence model of the exercise object extraction module 312 may receive the skeleton data of each of the candidate objects and may infer the exercise type of the candidate object A as a cable arm curl exercise, and may infer the exercise type of the candidate object B as a squat exercise. Here, when a user inputs a squat exercise as an exercise type through the weight training equipment 10 or the exercise support device 30, the exercise object extraction module 312 may extract the candidate object B as a main exercise object.

Referring back to FIG. 4, the exercise support device 30 according to the embodiment of the present disclosure may include the device management module 313. In the embodiment, the device management module 313 may be connected to the weight training equipment 10 through the terminal communication part 340 and may provide various functions necessary for a muscle exercise, in which the weight training equipment 10 is used, through cooperation with the weight training equipment 10.

For example, a user may input a target load through a terminal input part (or input device) 360, and the device management module 313 may transmit the target load input by the user to the weight training equipment 10 through the terminal communication part 340. In addition, when a user inputs an exercise type through the terminal input part 360, the device management module 313 may transmit information about the exercise type through the terminal communication part 340 to the weight training equipment 10. Furthermore, the device management module 313 may transmit the information about the input exercise type to the exercise object extraction module 312.

Here, the device management module 313 may display the graphic user interface for supporting a muscle exercise through the weight training equipment 10 on the video display part 330. Additionally, the device management module 313 may process an input signal which a user inputs through the graphic user interface displayed on the video display part 330, for example, a signal for selecting a target load or exercise type.

The exercise support device 30 according to the embodiment of the present disclosure may include a terminal control part (or terminal controller) 350. In the embodiment, the terminal control part 350 may include a hardware component and a software component which perform overall functions of the exercise support device 30. For example, the terminal control part 350 may include various operating systems (OS), middleware, platforms, and various applications, as well as program codes for signal processing and control, memories storing the same, and processors executing the same.

Here, the candidate object extraction module 311, the exercise object extraction module 312, and the device management module 313 according to the embodiment of the present disclosure may be configured in the form of one management application 310, and may be installed in the exercise support device 30. In addition, when the management application 310 is executed, the management application 310 may execute functions thereof in cooperation with the terminal control part 350.

The device management module 313 according to the embodiment of the present disclosure may adjust a captured video so that a main exercise object extracted by the exercise object extraction module 312 is displayed at a preset position on the screen and may display an adjusted captured video on the video display part 330. In the embodiment, as illustrated in FIG. 8, the size and position of a captured video may be adjusted so that the captured video is located in the central area of the screen of the graphic user interface provided by the device management module 313.

Figure 8:
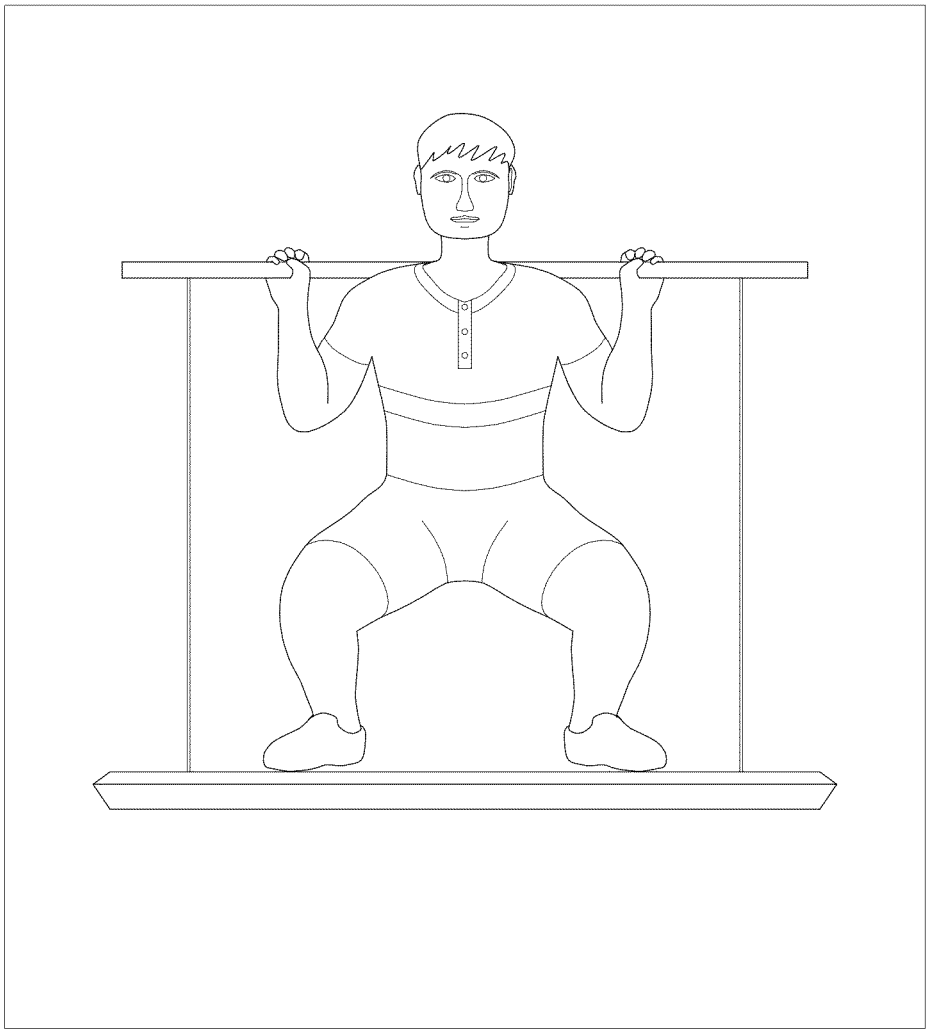
FIG. 8 is a view illustrating an example of a final exercise object displayed on a video display part of the exercise support device according to the embodiment of the present disclosure.

As illustrated in FIG. 7, in a state in which two persons are captured in a captured video, when the skeleton data of the plurality of candidate objects are extracted by the candidate object extraction module 311 and the exercise object extraction module 312 extracts a main exercise object among the plurality of candidate objects, the device management module 313 may zoom in and shift the captured video so that the main exercise object is located in the central area of the screen and may display an adjusted captured video on the video display part 330 as illustrated in FIG. 8.

Figure 9:
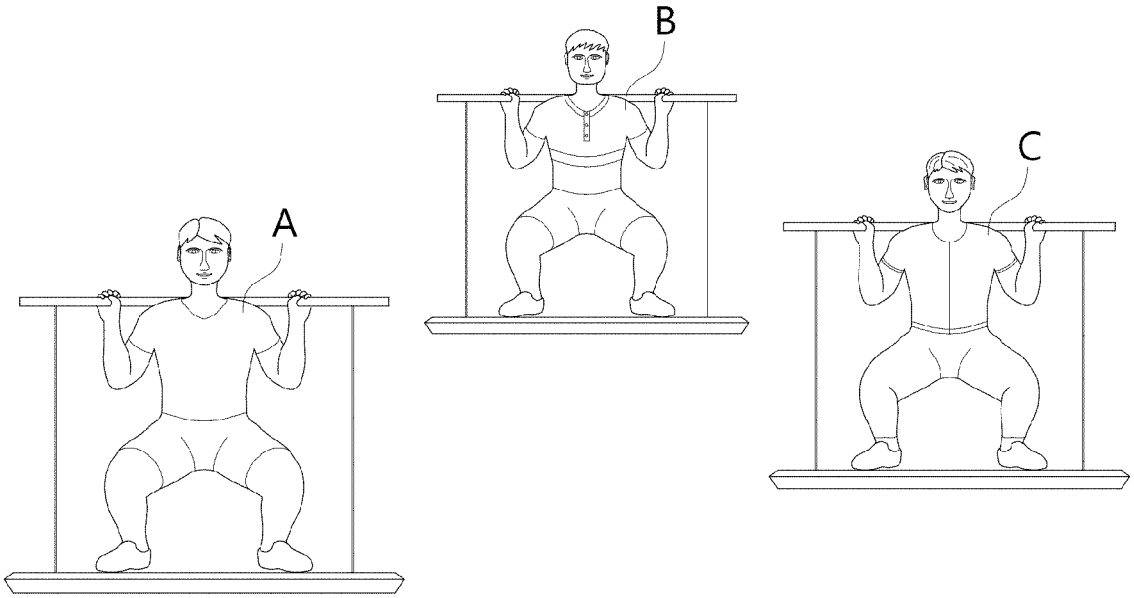
FIG. 9 is a view illustrating another example of the situation of exercise using the weight training equipment according to the embodiment of the present disclosure.

Meanwhile, FIG. 9 is a view illustrating another example of the situation of exercise using the weight training equipment 10 according to the embodiment of the present disclosure, and illustrates a situation in which three candidate objects are extracted in a video captured by the camera module 320. Unlike the example illustrated in FIG. 7, in FIG. 9, the three candidate objects A, B, and C are all performing squat exercises.

Accordingly, even if the skeleton data of the candidate objects are extracted by the candidate object extraction module 311, exercise types extracted by the exercise object extraction module 312 may be all squat exercises. Accordingly, the terminal communication part 340 of the exercise support device 30 according to the embodiment of the present disclosure may receive the device exercise information from the weight training equipment 10.

As described above, the equipment control part 170 of the weight training equipment 10 may take information about the moving-out position of the cable 120 detected by the position detection part 160 as the device exercise information and may transmit the device exercise information through the equipment communication part 140 to the exercise support device 30. Here, as illustrated in FIG. 9, when multiple main exercise objects corresponding to an exercise type are extracted, the exercise object extraction module 312 may calculate skeleton exercise information from the skeleton data of each of the main exercise objects.

In addition, the exercise object extraction module 312 may compare the skeleton exercise information with the device exercise information, and may extract one of the multiple main exercise objects as a final exercise object. In the embodiment, the exercise object extraction module 312 may extract at least one of a device exercise speed and a device exercise cycle from the device exercise information. Referring to FIG. 9, even if the main exercise objects A, B, and C are all performing squat exercises, the main exercise objects A, B, and C may be different from each other in exercise speeds or exercise cycles.

Accordingly, the exercise object extraction module 312 may calculate exercise speed of each of the main exercise objects based on the device exercise information, that is, the moving-out position of the cable 120. In addition, the exercise object extraction module may calculate an exercise cycle which is a one-time exercise based on the device exercise information.

In the embodiment, the exercise object extraction module 312 may extract an exercise skeleton corresponding to an exercise type from the skeleton data. In addition, the exercise object extraction module 312 may calculate at least one of the skeleton exercise speed and a skeleton exercise cycle according to the movement of the exercise skeleton, and may extract the final exercise object by comparing the device exercise speed or the device exercise cycle with the skeleton exercise information.

For example, in the case of a squat exercise, when the positions of the wrist and elbow in the skeleton data are extracted as exercise skeletons, the positions of the wrist and elbow may correspond to the moving-out position of the cable 120. Accordingly, based on the change of the positions of the wrist and elbow, the skeleton exercise speed or the skeleton exercise cycle may be calculated. For another example, in the case of a cable arm curl exercise illustrated in FIG. 7, when the position of the wrist in the skeleton data is extracted as an exercise skeleton, the position of the wrist may correspond to the moving-out position of the cable 120.

For another example, when the weight training equipment according to the embodiment of the present disclosure 10 is configured to enable treadmill exercise, the device exercise speed may be input. For example, when a user selects a treadmill exercise as an exercise type, the user may input a device exercise speed at which he or she will run through the terminal input part 360.

In addition, the device management module 313 may transmit the device exercise speed through the terminal communication part 340 to the weight training equipment 10. The equipment control part 170 may control the running speed of the weight training equipment 10 based on the device exercise speed received through the equipment communication part 140.

In the embodiment, when a plurality of main exercise objects corresponding to an exercise type is extracted, for example, when a plurality of main exercise objects in progress of a treadmill exercise is extracted, the exercise object extraction module 312 may extract an exercise skeleton corresponding to the exercise type from the skeleton data of each of the main exercise objects. For example, the exercise object extraction module 312 may extract knees and ankles in the process of treadmill exercise as exercise skeletons, and the skeleton exercise speed may be calculated according to the movement of the associated exercise skeletons. In addition, the exercise object extraction module 312 may compare the device exercise speed input through the terminal input part 360 with the skeleton exercise speed, and may extract one of the plurality of main exercise objects as a final exercise object.

Figure 10:
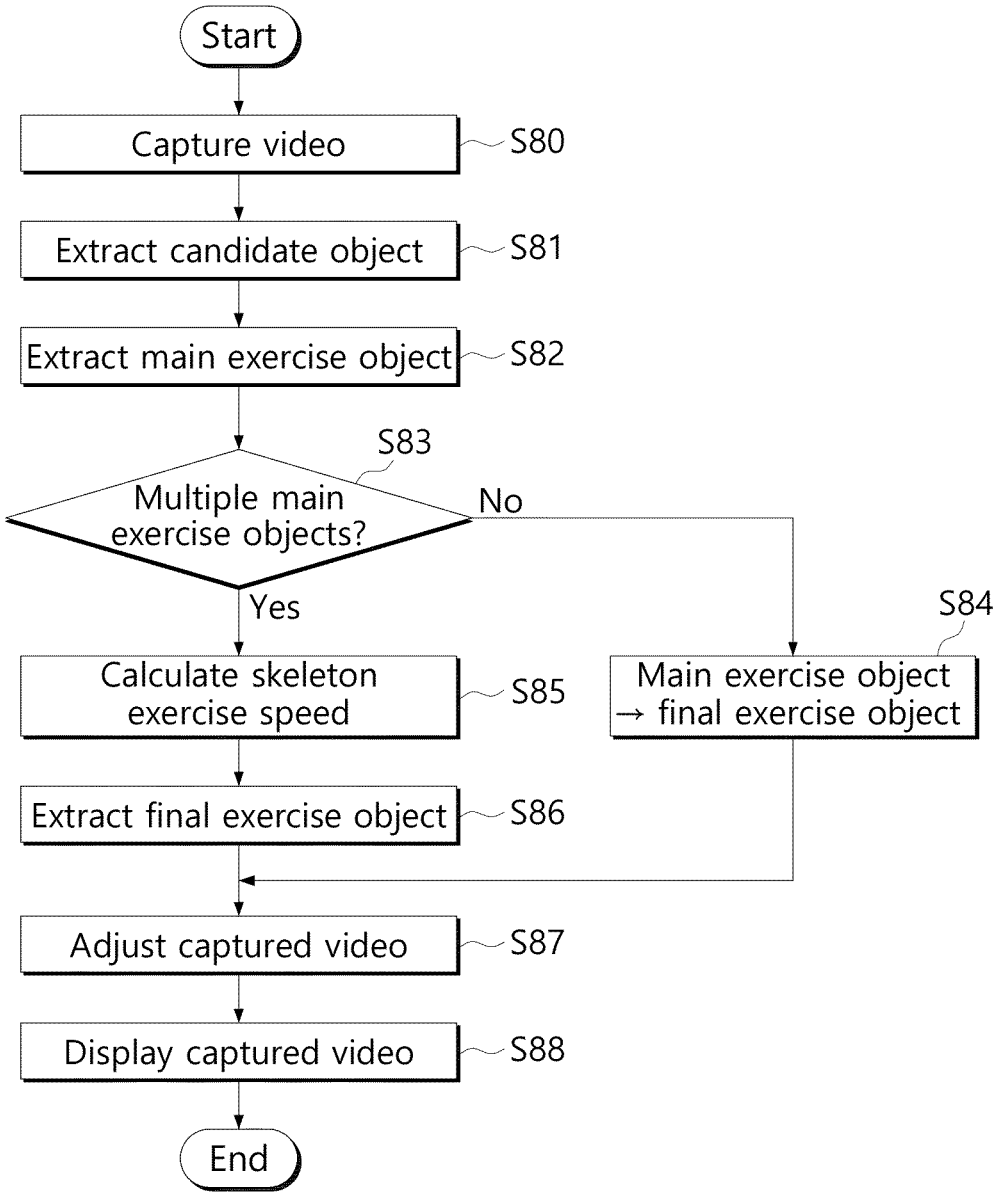
FIG. 10 is a control flowchart of the exercise support device according to the embodiment of the present disclosure.

Hereinafter, the control process of the exercise support device 30 according to the embodiment of the present disclosure will be described with reference to FIG. 10. First, as described above, when a user selects his/her exercise type and starts exercising, an exercise video is captured by the camera module 320 at S80. In addition, the candidate object extraction module 311 may extract candidate objects from the video captured by the camera module 320 at S81 and extract skeleton data of the candidate objects.

Next, the exercise object extraction module 312 may analyze the skeleton data of the candidate objects and extract a candidate object corresponding to a previously registered exercise type as a main exercise object at S82. Here, the exercise object extraction module 312 may determine whether a plurality of main exercise objects corresponding to the exercise type is detected at S83. When only one main exercise object is extracted, the exercise object extraction module 312 may extract the associated main exercise object as a final exercise object at S84.

On the other hand, when a plurality of main exercise objects is extracted at S83, the exercise object extraction module 312 may extract the exercise skeleton from the skeleton data of each of the main exercise objects, and may calculate the skeleton exercise speed based on the movement of the exercise skeleton at S85. In addition or alternatively, the exercise object extraction module 312 may calculate the device exercise information received through the terminal communication part 340 from the weight training equipment 10, that is, the device exercise speed based on the moving-out position of the cable 120, and may extract the main exercise object having the skeleton exercise speed corresponding to the device exercise speed as the final exercise object by comparing the skeleton exercise speed with the device exercise speed at S86.

When the final exercise object is extracted as described above, the device management module 313 may adjust a video captured by the camera module 320 at S87 and may display an adjusted captured video on the video display part 330 with the final exercise object located in the central area of the screen at S88 as illustrated in FIG. 8.

The present disclosure is intended to propose an exercise support device operating with a weight training equipment which can specify a user who exercises on the weight training equipment from a captured video. The present disclosure is further intended to propose an exercise support device which can accurately specify a user which exercises on a weight training equipment presently operating with the exercise support device when there are many exercise objects in an exercise video. The present disclosure is still further intended to propose an exercise support device which applies a method of specifying at least one exercise object so that a user can be more accurately specified. The present disclosure is still further intended to propose an exercise support device in which only a user who is presently using a weight training equipment can be displayed on a screen to increase the concentration of exercise.

The exercise support device operating with a weight training equipment according to an embodiment of the present disclosure may extract an exercise object who exercises on a weight training equipment, which is presently connected to the exercise support device, from a video captured by a camera module by analyzing skeleton data of candidate objects. In the embodiment, the exercise support device according to the embodiment of the present disclosure may include a candidate object extraction module. The candidate object extraction module may extract the skeleton data of the plurality of candidate objects in the video captured by the camera module.

The exercise support device according to the embodiment of the present disclosure may include an exercise object extraction module. The exercise object extraction module may analyze the skeleton data of each of the candidate objects, and may extract one of the plurality of candidate objects, as a main exercise object, corresponding to an exercise type performed by the weight training equipment connected to the exercise support device through a terminal communication part.

The exercise support device according to the embodiment of the present disclosure may include a device management module. In the embodiment, the device management module may adjust the captured video so that the main exercise object extracted by the exercise object extraction module is displayed at a preset position on a screen and may display an adjusted captured video on a video display part. For example, the terminal communication part may receive information about the exercise type performed by the weight training equipment from the weight training equipment. Here, the exercise object extraction module may extract the main exercise object based on the information about the exercise type received through the terminal communication part.

For another example, the device management module may receive information about an exercise type to be performed by the weight training equipment. In addition, the exercise object extraction module may extract the main exercise object based on the exercise type input to the device management module.

The terminal communication part according to the present disclosure may receive device exercise information from the weight training equipment. In addition, the exercise object extraction module may calculate skeleton exercise information from skeleton data of each of a plurality of main exercise objects when the plurality of main exercise objects corresponding to the exercise type is extracted. In addition, the exercise object extraction module may extract one of the plurality of main exercise objects as a final exercise object by comparing the skeleton exercise information with the device exercise information.

In the embodiment, the exercise object extraction module may calculate at least one of a device exercise speed and a device exercise cycle from the device exercise information. In addition, the exercise object extraction module may extract the final exercise object by comparing at least one of the device exercise speed and the device exercise cycle with the skeleton exercise information.

In the embodiment, the exercise object extraction module may extract an exercise skeleton corresponding to the exercise type from the skeleton data. In addition, the exercise object extraction module may calculate at least one of a skeleton exercise speed and a skeleton exercise cycle according to movement of the exercise skeleton. In addition, the exercise object extraction module may extract the final exercise object by comparing the skeleton exercise information with the device exercise speed or the device exercise cycle.

In the embodiment of the present disclosure, the device management module may receive the device exercise speed according to the exercise type, and may transmit the device exercise speed through the terminal communication part to the weight training equipment. In addition, when the plurality of main exercise objects corresponding to the exercise type is extracted, the exercise object extraction module may extract the exercise skeleton corresponding to the exercise type from the skeleton data of each of the main exercise objects.

In addition, the exercise object extraction module may calculate the skeleton exercise speed according to the movement of the exercise skeleton and may extract the final exercise object by comparing the device exercise speed with the skeleton exercise speed. In the embodiment, the device management module may enlarge and display the captured video so that the main exercise object is displayed on the video display part with the main exercise object located in a central area of the screen.

In the embodiment, the exercise object extraction module may include an artificial intelligence model in which a plurality of skeleton data for learning which is each labeled with exercise types is used as learning data, and the exercise types are used as output data to be learned and generated. In addition, the artificial intelligence model may receive the skeleton data of each of the candidate objects and may determine the exercise type of the candidate object.

The exercise support device operating with the weight training equipment according to the present disclosure may have at least one of the following effects. First, the present disclosure provides the exercise support device which can accurately specify, from a captured video, a user exercising on the weight training equipment connected currently to the exercise support device. Second, the present disclosure provides the exercise support device which can accurately specify a user exercising on the weight training equipment operating presently with the exercise support device by using exercise types and the skeleton data of candidate objects when the multiple candidate objects are detected in an exercise video. Third, a user can be accurately specified based on the device exercise information of the weight training equipment and skeleton exercise information extracted from the skeleton data when there are multiple candidate objects who exercise in the same exercise type. Fourth, a user's exercise video is displayed in the central area of the screen of the video display part so that the user can exercise while checking his or her exercise video, thereby increasing the concentration of exercise.

Although the embodiments of the present disclosure have been described above with reference to the accompanying drawings, the weight training equipment of the present disclosure is not limited to the above embodiments, but may be manufactured in various different forms. Those skilled in the technical field to which the present disclosure belongs will be able to understand that the weight training equipment of the present disclosure may be configured in other specific forms without changing the technical idea or essential characteristics of the present disclosure. Therefore, it should be understood that the embodiments described above are illustrative in all respects and not restrictive.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An exercise support device operating with weight training equipment, the exercise support device comprising:

a terminal communication interface that communicates with the weight training equipment;

a display; and a controller that:

extracts skeleton data of each of a plurality of candidate objects in at least one images captured by a camera, analyzes the skeleton data of each of the candidate objects and extracts a main exercise object corresponding to one of the plurality of candidate objects matching an exercise type performed by a user with the weight training equipment, adjusts the captured at least one image so that the main exercise object is displayed at a particular position on the display, receives, via the terminal communication interface and from the weight training equipment, information about the exercise type performed by the user with the weight training equipment, and extracts the main exercise object based on the information about the exercise type received through the terminal communication interface, wherein the weight training equipment includes:

a cable moved by the user when performing the exercise; and a sensor to detect a movement of the cable, and wherein the information about the exercise type performed by the user with the weight training equipment includes information detected by the sensor regarding the movement of the cable.

2. The exercise support device of claim 1, wherein the controller, when adjusting the at least one image, enlarges the at least one image and positions the main exercise object to be located in a central area of the display.

3. The exercise support device of claim 1, wherein the controller, when analyzing the skeleton data of each of the candidate objects and extracting one of the plurality of candidate objects, uses an artificial intelligence model in which a plurality of skeleton data for learning which are each labeled with exercise types is used as learning data and the exercise types are used as output data to be learned and generated, the artificial intelligence model receiving the skeleton data of each of the candidate objects and determining corresponding exercise types of the candidate objects.

4. An exercise support device operating with weight training equipment, the exercise support device comprising:

a terminal communication interface that communicates with the weight training equipment;

a display; and a controller that:

extracts skeleton data of each of a plurality of candidate objects in at least one images captured by a camera, analyzes the skeleton data of each of the candidate objects and extracts a main exercise object corresponding to one of the plurality of candidate objects matching an exercise type performed by a user with the weight training equipment, adjusts the captured at least one image so that the main exercise object is displayed at a particular position on the display, receives, via the terminal communication interface, device exercise information from the weight training equipment, calculates skeleton exercise information from the skeleton data of each of a plurality of main exercise objects corresponding to the exercise type when the plurality of main exercise objects are extracted, and extracts one of the plurality of main exercise objects as a final exercise object corresponding to the extracted main exercise object based on comparing the skeleton exercise information with the device exercise information.

5. The exercise support device of claim 4, wherein the controller calculates at least one of a device exercise speed or a device exercise cycle from the device exercise information, and extracts the final exercise object based on comparing the least one of the device exercise speed or the device exercise cycle with the skeleton exercise information.

6. The exercise support device of claim 5, wherein the controller:

extracts an exercise skeleton corresponding to the exercise type from the skeleton data, calculates at least one of a skeleton exercise speed or a skeleton exercise cycle according to a movement of the exercise skeleton, and extracts the final exercise object by comparing the at least one of the skeleton exercise speed or the skeleton exercise cycle with the at least one of the device exercise speed or the device exercise cycle.

7. An exercise support device operating with weight training equipment the exercise support device comprising:

a terminal communication interface that communicates with the weight training equipment;

a display; and a controller that:

extracts skeleton data of each of a plurality of candidate objects in at least one images captured by a camera analyzes the skeleton data of each of the candidate objects and extracts a main exercise object corresponding to one of the plurality of candidate objects matching an exercise type performed by a user with the weight training equipment, adjusts the captured at least one image so that the main exercise object is displayed at a particular position on the display, identifies a device exercise speed according to the exercise type and transmits the device exercise speed through the terminal communication interface to the weight training equipment, extracts an exercise skeleton corresponding to the exercise type from skeleton data of each of a plurality of main exercise objects corresponding to the exercise type when the plurality of main exercise objects is extracted, calculates a skeleton exercise speed according to a movement of the exercise skeleton, and extracts a final exercise object based on comparing the device exercise speed with the skeleton exercise speed.

8. A method for operating an exercising support device communicating with weight training equipment, the method comprising:

capturing an image or a video;

extracting, by a processor of the exercising support device, skeleton data of at least one candidate object in the at least one image;

analyzing, by the processor, the skeleton data of the at least one candidate object, and extracting a main exercise object corresponding to one of the at least one candidate object matching an exercise type performed by a user with the weight training equipment; and adjusting, by the processor, the captured image or video so that the main exercise object is presented on a display of the exercising support device, wherein extracting the main exercise object includes:

receiving, from the weight training equipment, information about the exercise type performed by the user with the weight training equipment; and extracting the main exercise object based on the information about the exercise type received through a terminal communication interface, wherein the weight training equipment includes:

a cable moved by the user when performing the exercise; and a sensor to detect a movement of the cable, and wherein the information about the exercise type performed by the user with the weight training equipment includes information detected by the sensor regarding the movement of the cable.

9. The method of claim 8, wherein adjusting the at least one image includes:

enlarging the at least one image and positioning the main exercise object to be located in a central area of the display.

10. The method of claim 8, wherein analyzing the skeleton data of the at least one candidate object and extracting one of the at least one candidate object includes:

using an artificial intelligence model in which a plurality of skeleton data for learning which are each labeled with exercise types is used as learning data and the exercise types are used as output data to be learned and generated, the artificial intelligence model receiving the skeleton data of each of the candidate objects and determining corresponding exercise types of the candidate objects.

11. A method for operating an exercising support device communicating with weight training equipment, the method comprising:

capturing an image or a video;

extracting, by a processor of the exercising support device, skeleton data of at least one candidate object in the at least one image;

analyzing, by the processor, the skeleton data of the at least one candidate object, and extracting a main exercise object corresponding to one of the at least one candidate object matching an exercise type performed by a user with the weight training equipment; and adjusting, by the processor, the captured image or video so that the main exercise object is presented on a display of the exercising support device, wherein extracting the main exercise object includes:

receiving device exercise information from the weight training equipment;

calculating skeleton exercise information from the skeleton data of each of a plurality of main exercise objects corresponding to the exercise type when extracting the plurality of main exercise objects; and extracting one of the plurality of main exercise objects as a final exercise object corresponding to the extracted main exercise object based on comparing the skeleton exercise information with the device exercise information.

12. The method of claim 11, wherein extracting the main exercise object includes:

calculating at least one of a device exercise speed or a device exercise cycle from the device exercise information, and extracting the final exercise object based on comparing the least one of the device exercise speed or the device exercise cycle with the skeleton exercise information.

13. The method of claim 12, wherein extracting the main exercise object includes:

extracting an exercise skeleton corresponding to the exercise type from the skeleton data;

calculating at least one of a skeleton exercise speed or a skeleton exercise cycle according to a movement of the exercise skeleton; and extracting the final exercise object by comparing the at least one of the skeleton exercise speed or the skeleton exercise cycle with the at least one of the device exercise speed or the device exercise cycle.

14. A method for operating an exercising support device communicating with weight training equipment, the method comprising:

capturing an image or a video;

extracting, by a processor of the exercising support device, skeleton data of at least one candidate object in the at least one image;

analyzing, by the processor, the skeleton data of the at least one candidate object, and extracting a main exercise object corresponding to one of the at least one candidate object matching an exercise type performed by a user with the weight training equipment; and adjusting, by the processor, the captured image or video so that the main exercise object is presented on a display of the exercising support device, wherein extracting the main exercise object includes:

identifying a device exercise speed according to the exercise type and transmits the device exercise speed through the terminal communication interface to the weight training equipment;

extracting an exercise skeleton corresponding to the exercise type from skeleton data of each of a plurality of main exercise objects corresponding to the exercise type when the plurality of main exercise objects is extracted;

calculating a skeleton exercise speed according to a movement of the exercise skeleton; and extracting a final exercise object based on comparing the device exercise speed with the skeleton exercise speed.

15. An exercise system comprising:

weight training equipment including an equipment communication interface; and an exercising support device including:

a terminal communication interface that communicates with the equipment communication interface; and a controller that:

extracts skeleton data of each of a plurality of candidate exercises in at least one image captured by a camera;

determines, based on the skeleton data, an exercise type performed by a user with the weight training equipment; and provides information regarding the exercise type performed by the user to the weight training equipment, wherein the weight training equipment includes:

a motor, a cable coupled to the motor and moved by the user when performing the exercise, and a sensor to detect a movement of the cable; and wherein the controller of the exercising support device further determines the exercise type performed by the user based on information detected by the sensor regarding the movement of the cable.

* * * * *